US007584567B1

(12) United States Patent
DeSomma et al.

(10) Patent No.: US 7,584,567 B1
(45) Date of Patent: Sep. 8, 2009

(54) HAND GUARD ASSEMBLY FOR FIREARMS

(76) Inventors: Frank DeSomma, 23623 N. 67th Ave., Glendale, AZ (US) 85310; Robert B. Davies, 433 E. McKinley St., Tempe, AZ (US) 85281-1026

( * ) Notice: Subject to any disclaimer, the term of this patent is extended or adjusted under 35 U.S.C. 154(b) by 0 days.

(21) Appl. No.: 12/110,304

(22) Filed: Apr. 26, 2008

Related U.S. Application Data

(62) Division of application No. 11/174,270, filed on Jun. 29, 2005, now Pat. No. 7,363,741.

(60) Provisional application No. 60/585,746, filed on Jul. 6, 2004.

(51) Int. Cl.
*F41C 23/16* (2006.01)

(52) U.S. Cl. ..... 42/71.01

(58) Field of Classification Search ..... 42/71.01, 42/72

See application file for complete search history.

(56) References Cited

U.S. PATENT DOCUMENTS 1,357,208 A * 10/1920 Payne ..... 42/75.01
2,110,165 A * 3/1938 Moore ..... 42/75.02
2,124,075 A * 7/1938 Moore ..... 89/14.1
2,437,548 A * 3/1948 Patchett ..... 42/72
2,467,372 A * 4/1949 De Permentier ..... 89/14.1
2,816,484 A * 12/1957 Grages ..... 89/194
3,051,057 A * 8/1962 Ivy ..... 89/193
4,651,455 A * 3/1987 Geiser, Jr. ..... 42/18
6,508,159 B1 * 1/2003 Muirhead ..... 89/14.1
2003/0010186 A1 * 1/2003 Muirhead ..... 89/14.1

* cited by examiner

*Primary Examiner*—Bret Hayes
(74) *Attorney, Agent, or Firm*—Parsons & Goltry; Robert A. Parsons; Michael W. Goltry

(57) ABSTRACT

A hand guard assembly for a firearm including a barrel. The assembly includes a tubular unitary body mounted to surround a portion of the barrel substantially coaxially and in a transversely spaced relationship. The tubular body includes a plurality of air flow openings formed therethrough and at least one of a top rail formed as a unitary portion of the tubular body and extending rearwardly along an upper portion of a receiver of the firearm, side accessory rails formed as a unitary portion of the tubular body and on opposed sides of the tubular body, and a bottom accessory rail formed as a unitary portion of the tubular body and on a bottom surface of the tubular body. In the preferred method of fabricating the assembly, the body and any include accessory rails are extruded.

12 Claims, 5 Drawing Sheets

HAND GUARD ASSEMBLY FOR FIREARMS

CROSS-REFERENCE TO RELATED APPLICATIONS

This application is a divisional application of currently U.S. application Ser. No. 11/174,270, filed 29 Jun. 2005, now U.S. Pat. No. 7,363,741 which claims the benefit of U.S. Provisional Application No. 60/585,746, filed 6 Jul. 2004.

FIELD OF THE INVENTION

This invention relates to accessories for firearms.

More particularly, the present invention relates to hand guards that may include one or more accessory rails.

BACKGROUND OF THE INVENTION

It is understood that hand-held firearms require some type of handgrip so that the operator can hold the firearm as it is fired. Also, many accessories are available that aid in the proper and/or enhanced operation of firearms and some type of platform or mounting structure is generally provided or available as an accessory for this function. Further, many firearms are operated as automatic or semiautomatic and have a tendency to heat extensively so that handgrips attached directly to the barrel can produce hand burns for the operator if great care is not taken. In addition, anything attached directly to the barrel of a firearm can have a tendency to alter the barrel slightly and any alterations can adversely affect the accuracy of the firearm.

As understood by those skilled in the art, firearms of the type discussed herein generally include a receiver a stock attached to one end of the receiver and a barrel attached to the other end of the receiver. In most instances the barrel screws into an opening in the receiver and includes a barrel nut adjacent the receiver for assembling the barrel into the receiver. In most instances, handgrips or hand guards and accessory mounting devices are attached to the barrel. Further, the operator must grip the firearm on or adjacent the barrel to stabilize the firearm during operation. Thus, hand guards generally surround at least portions of the barrel to provide the operator a place to grip the firearm and to protect the hand from the heat of the barrel.

One of the main problems that arises is the weight that hand guards and accessory mounting devices add to the firearm. Clearly, the hand guards and accessory mounting devices must be constructed ruggedly and to withstand heavy use. In the prior art, hand guards are constructed of a plurality of components that are fixed together around the barrel, generally by screws or the like. Because the prior art hand guards are formed with multiple components, they must be constructed with larger and heavier areas or portions (e.g. mating edges, etc.) that are adapted to allow the components to be fixed together.

It would be highly advantageous, therefore, to remedy the foregoing and other deficiencies inherent in the prior art.

Accordingly, it is an object of the present invention to provide a new and improved hand guard assembly.

Another object of the invention is to provide a new and improved hand guard assembly that is relatively light weight.

Another object of the invention is to provide a new and improved hand guard assembly and that may include one or more accessory mounting devices.

Another object of the invention is to provide a new and improved hand guard assembly that is simpler to manufacture and to install.

Another object of the invention is to provide a new and improved hand guard assembly that is relatively cool and that enhances air flow over the underlying barrel.

SUMMARY OF THE INVENTION

Briefly, to achieve the desired objects of the instant invention in accordance with a preferred embodiment thereof, provided is a hand guard assembly for a firearm including a barrel. The assembly includes a tubular unitary body mounted to surround a portion of the barrel substantially coaxially and in a transversely spaced relationship. The tubular body includes a plurality of air flow openings formed therethrough. The hand guard assembly may also include any one of a top rail formed as a unitary portion of the tubular body and extending rearwardly along an upper portion of a receiver of the firearm, side accessory rails formed as a unitary portion of the tubular body and on opposed sides of the tubular body, and a bottom accessory rail formed as a unitary portion of the tubular body and on a bottom surface of the tubular body.

In a preferred method of fabricating the assembly, the body and any included accessory rails are extruded as a unitary structure. Also, portions of material are removed from the accessory rails to define the air flow openings as well as opposed longitudinally extending side grooves, the side grooves defining external reference surfaces for mounting accessories, a longitudinally extending central groove formed midway between the opposed side grooves and defining internal reference surfaces for mounting accessories, a plurality of transverse ribs with adjacent ribs being separated by cross-cuts, and a plurality of pocket cuts formed intermediate the transverse ribs and along the central groove. The removal of the material also substantially reduces the weight and thermal mass.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
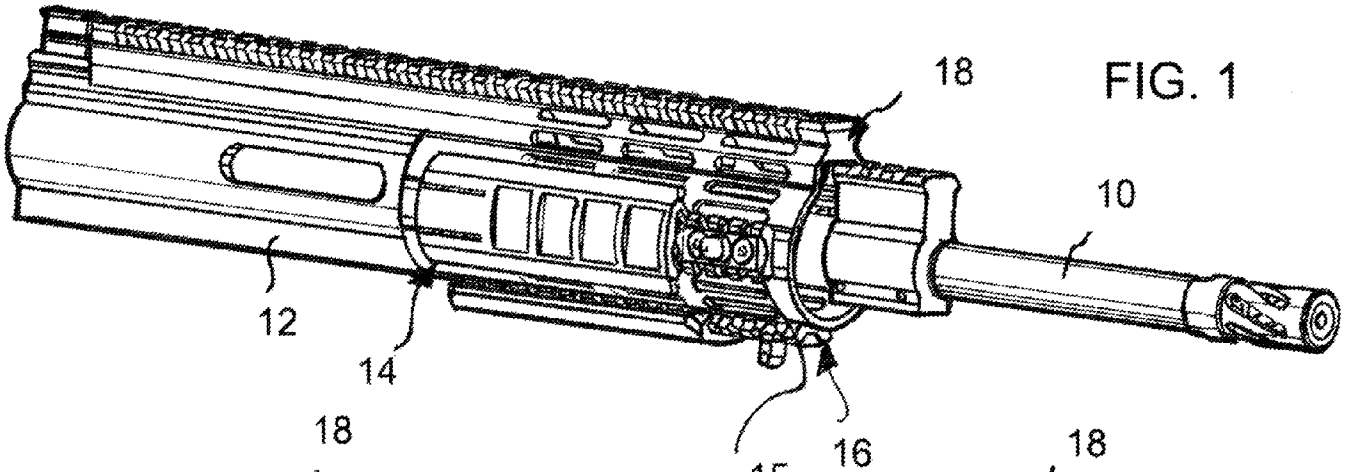
FIG. 1 is a perspective view of a portion of a firearm illustrating a hand guard assembly according to the present invention.
Figure 6:
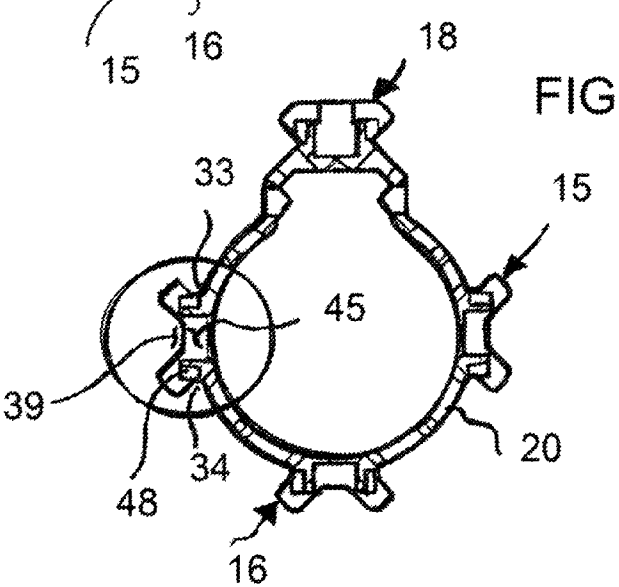
FIG. 6 is a sectional view of the hand guard assembly of FIG. 2, taken along line 6-6.
Figure 5:
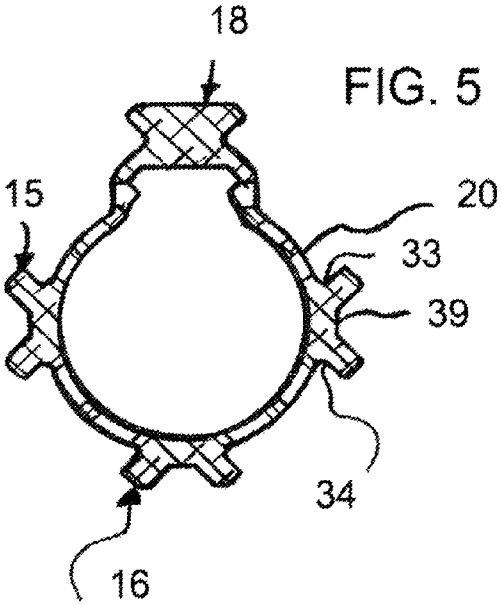
FIG. 5 is a sectional view of the hand guard assembly of FIG. 2, taken along line 5-5.
Figure 4:
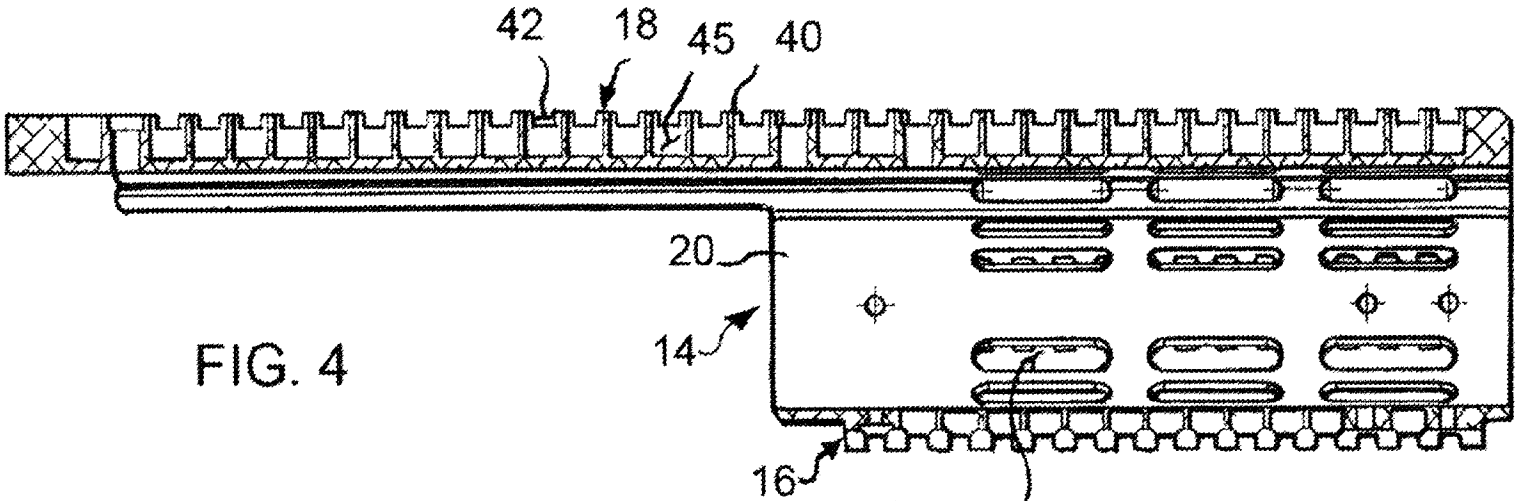
FIG. 4 is a sectional side view of the hand guard assembly, taken along line 4-4 of FIG. 2.

Turning now to the drawings in which like reference characters indicate corresponding elements throughout the several views, attention is directed to FIG. 1 which illustrates a portion of a firearm having a barrel 10 extending from an upper receiver 12. A hand guard 14, including side accessory rails 15, bottom accessory rail 16 and top rail 18, is carried by the portion of the firearm illustrated. Hand guard 14 is preferably extruded as a single piece having each element integrally formed therewith. This unitary construction adds strength while allowing removal of material, as will be described presently, to reduce weight and thermal mass. While hand guard 14 is illustrated mounted on a rifle, it will be understood that it may be mounted on substantially any firearm. Additionally, while side accessory rails 15, bottom accessory rail 16 and top rail 18 are illustrated carried by hand guard 14, some or all may be omitted as desired or included in conjunction with other firearms and/or other hand guard systems, as will be explained in more detail below. Hand guard 14 and/or any or all of side accessory rails 15, bottom accessory rail 16 and top rail 18 are referred to herein generally as a "hand guard assembly". Additionally, the unique structure of the accessory rails, as will be described presently, can be employed on any firearm, including artillery pieces, without the use of a hand guard or in conjunction with other hand guard systems. The accessory rails adhere to all the critical dimensions of the Mil-1913 standard Picatinny rail.

Figure 2:
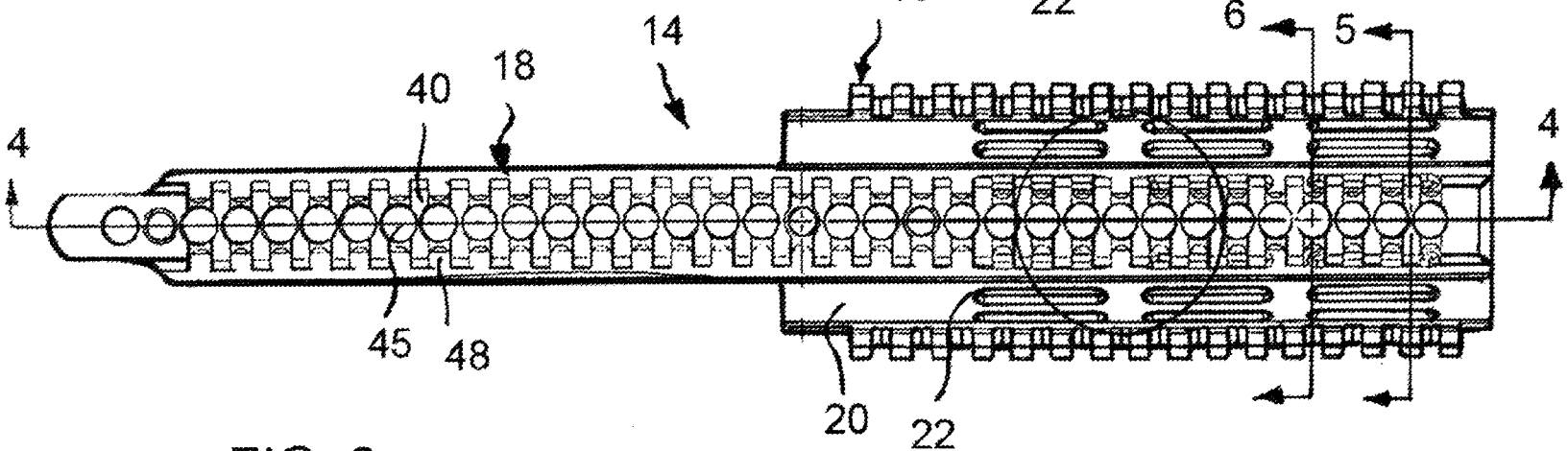
FIG. 2 is a top plan view of the hand guard assembly of FIG. 1.
Figure 3:
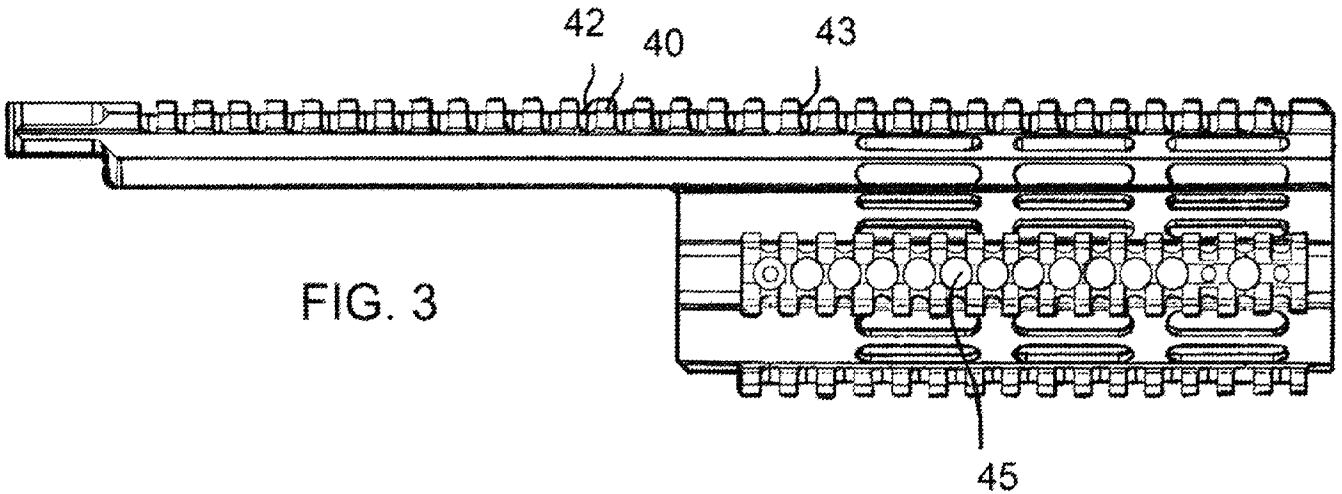
FIG. 3 is a side plan view of the hand guard assembly of FIG. 2.
Figure 7:
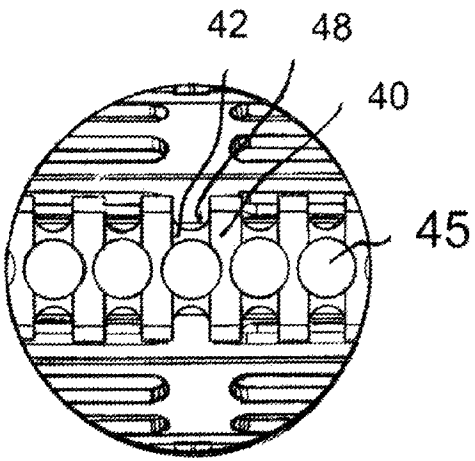
FIG. 7 is an enlarged partial view of the hand guard assembly of FIG. 2.
Figure 8:
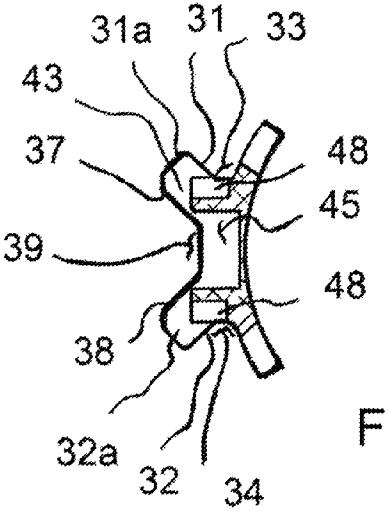
FIG. 8 is a sectional view of a portion of a rail of FIG. 7.
Figure 9:
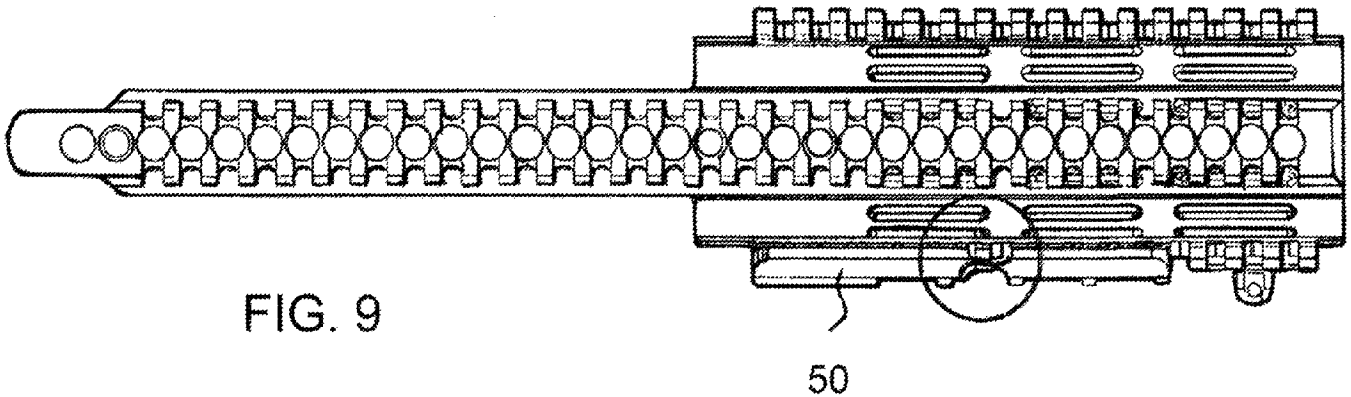
FIG. 9 is a top plan view illustrating the hand guard assembly including an accessory rail system, according to the present invention, with a rail cover and an accessory mounted on a side rail.
Figure 11:
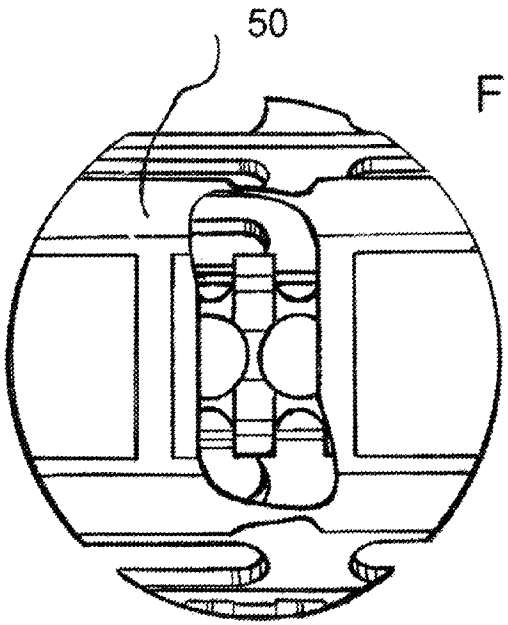
FIG. 11 is an enlarged partial side view of the hand guard assembly with portions of the rail cover cutaway.
Figure 10:
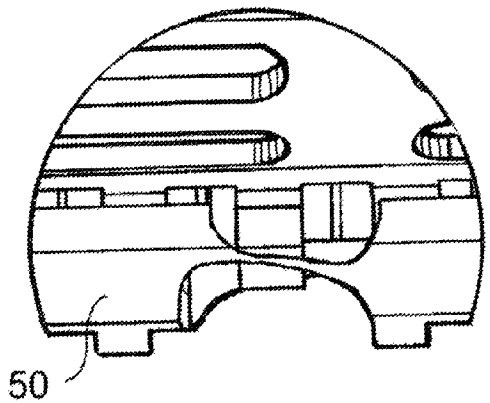
FIG. 10 is an enlarged partial top view of the hand guard assembly with portions of the rail cover cutaway.

Referring now to FIG. 2, the following description of hand guard 14 includes a description of the various accessory rails. Those skilled in the art will understand that hand guard 14 may be employed without accessory rails, and conversely, the accessory rails can be employed on other hand guard systems or firearms in general. Hand guard 14 includes a tubular body 20 which is received about barrel 10 of the firearm. Tubular body 20 is preferably fabricated of metal, such as aluminum, by extrusion. In this preferred embodiment, side accessory rails 15, bottom accessory rail 16, and top rail 18 are extruded with body 20 in a unitary piece. Top rail 18 is preferably formed with tubular body 20 and is typically employed to engage the top rail of upper receiver 12. Hand guard 14 can, for example, engage the barrel nut of barrel 10 for support, with additional support being provided by top rail 18, if present. In this fashion hand guard 14 is supported in spaced relationship to barrel 10 to allow air flow therebetween.

In the event that one or all of side accessory rails 15, bottom accessory rail 16, and top rail 18 are used without tubular body 20, they may be attached to a firearm by means of another hand guard system or by structure other than a hand guard, e.g. attachment rings, rails, or other mounting devices. In this disclosure, structure mounting one or all of side accessory rails 15, bottom accessory rail 16, and top rail 18 is included in the term "mounting structure", which is intended to include any structure mounting one or all of side accessory rails 15, bottom accessory rail 16, and top rail 18 on a firearm, including tubular body 20. Further, one or all of side accessory rails 15, bottom accessory rail 16, and top rail 18 and the mounting structure for the rail or rails in included in the term "hand guard assembly" as used in this disclosure.

Hand guard 14 is a unitary structure including accessory rails, and material removed to greatly reduce weight without affecting strength. In this disclosure the term "unitary" denotes a construction in which all of the components are formed integrally or as a single piece. Longitudinal slots/openings 22 are formed in body 20 intermediate side accessory rails 15 and bottom accessory rail 16 to reduce weight and promote airflow between body 20 and barrel 10. Due to the unitary nature of hand guard 14 with associated rails, removal of material does not substantially weaken the overall structure.

With continued reference to FIG. 2, and additional reference to FIGS. 3-8, the weight of hand guard 14 is further reduced by removing material from the accessory rails. Side accessory rails 15 and bottom accessory rail 16 are substantially identical, therefore only one will be described in detail. Side accessory rails 15 include inner external referencing surfaces 31 and 32 (best seen in FIG. 8), defined by opposing longitudinal side grooves 33 and 34, respectfully. Outer external referencing surfaces 31*a* and 32*a* adjoin inner external referencing surfaces 31 and 32. Internal referencing surfaces 37 and 38 are defined by a central longitudinal groove 39. A plurality of equally spaced transverse ribs 40 (best seen in FIG. 7) are formed the length of accessory rail 15 by a plurality of crosscuts 42. Transverse ribs 40 include vertical thrust surfaces 43 which prevent forward and rearward movement of accessories attached thereto. Pocket cuts 45 are formed intermediate transverse ribs 40 along central groove 39. The inclusion of pocket cuts 45 greatly reduces the weight and thermal mass of hand guard 14. Pocket cuts 45 can be formed completely through the material in the form of through holes, to provide higher levels of air flow. This is not preferred on the top rail, as heated air can cause distortions in the sight path. To complete the shape of accessory rails 15, undercuts 48 are formed between each rib 40 from each longitudinal side groove to the crosscuts 42. Undercuts 48 join longitudinal side grooves 33 and 34 with crosscuts 42 and pocket cuts 45 to form an air path transversely through each accessory rail.

The air path is illustrated with reference to FIGS. 9-12. As can be seen, when a rail cover 50 is placed on side accessory rail 15, undercuts 48 provide air access under cover 50. In this manner, circulating air continues to cool hand guard 14 even with rail covers 50 in place.

Figure 12:
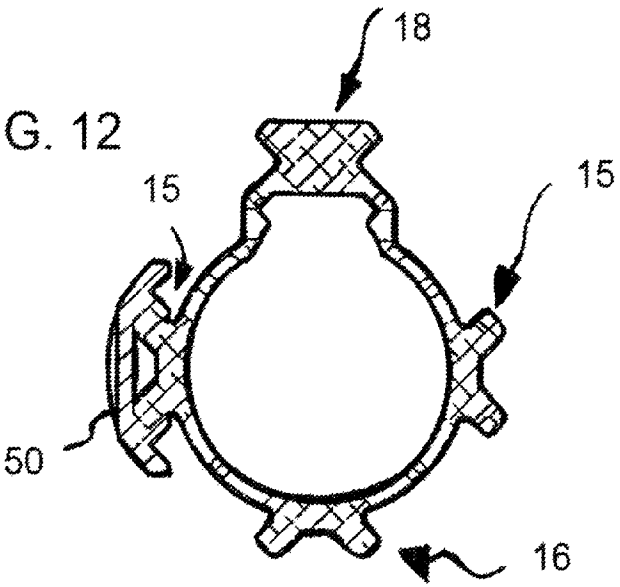
FIG. 12 is a sectional view of the hand guard assembly illustrated in FIG. 9 with a rail cover mounted on a side accessory rail.
Figure 13:
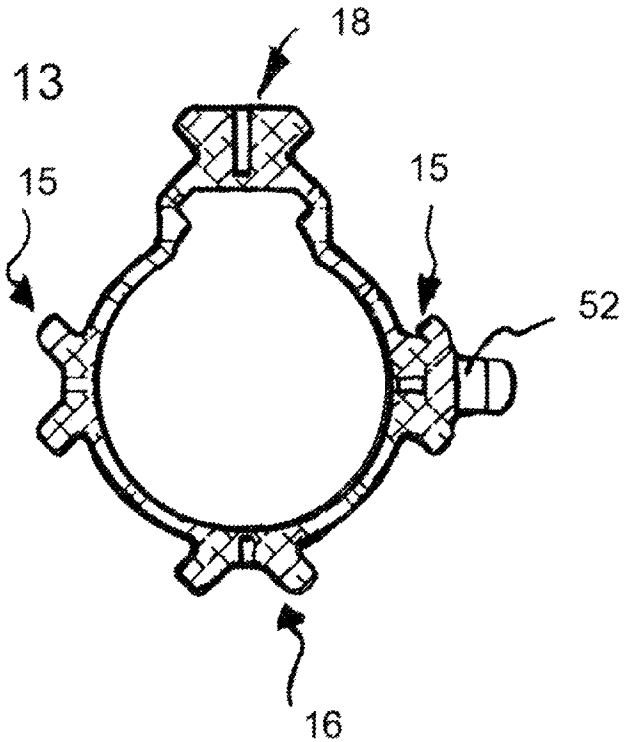
FIG. 13 is a sectional view of the hand guard assembly illustrated in FIG. 9 with an accessory carried by a side accessory rail.

Turning now to FIG. 12, rail cover 50 is illustrated coupled to side accessory rail 15. It will be understood that rail covers 50 can also be affixed to bottom accessory rail 16. With reference to FIG. 13, an example of an accessory, sling mount 52, is illustrated carried by side accessory rail 15. Many accessories clamp over the rail and are indexed by external referencing surfaces 31, 32 and/or 31*a*, 32*a* (see for example rail cover 50 in FIG. 12). In this example, sling mount 52 is indexed by internal referencing surfaces 37, 38. Thus, various accessories can be employed using either external indexing surfaces or internal indexing surfaces. Additionally, it should be understood that top rail 18 is substantially similar to accessory rails 15 and 16, with the omission of central groove 39. It should also be understood that the central groove 39 can be employed if desired.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A method of fabricating a hand guard assembly for a firearm including a barrel, the method comprising the steps of:

extruding a tubular unitary body with an inner diameter sufficient to surround a portion of the barrel substantially coaxially and in a transversely spaced relationship;

the step of extruding the tubular body includes forming a top rail to extend rearwardly along an upper portion of a receiver of the firearm, the top rail being extruded as a unitary portion of the tubular body;

the step of forming the top rail includes forming a plurality of transverse ribs, adjacent ribs of the plurality of transverse ribs being defined and separated by crosscutting the top rail; and forming a plurality of air flow openings through the extruded tubular unitary body by removing material from the body.

2. A method as claimed in claim 1 wherein the step of forming a plurality of air flow openings includes forming the air flow openings as longitudinally extending slots.

3. A method as claimed in claim 1 wherein the step of forming the top rail includes introducing a plurality of pocket cuts intermediate adjacent transverse ribs.

4. A method as claimed in claim 1 wherein the step of extruding the tubular unitary body further includes forming a bottom accessory rail on a bottom surface of the tubular body, the bottom accessory rail being extruded as a unitary portion of the tubular body.

5. A method of fabricating a hand guard assembly for a firearm including a barrel, the method comprising the steps of:

extruding a tubular unitary body with an inner diameter sufficient to surround a portion of the barrel substantially coaxially and in a transversely spaced relationship; and forming a plurality of air flow openings through the extruded tubular unitary body by removing material from the body;

the step of extruding the tubular unitary body further includes forming side accessory rails on opposed sides of the tubular body, the side accessory rails being extruded as a unitary portion of the tubular body; and the step of forming the side accessory rails includes forming opposed longitudinally extending side grooves in each of the opposed side accessory rails, the side grooves being formed to define external reference surfaces for mounting accessories.

6. A method as claimed in claim 5 wherein the step of forming the side accessory rails includes forming a longitudinally extending central groove in each of the side accessory rails midway between the opposed side grooves, the central groove being formed to define internal reference surfaces for mounting accessories.

7. A method as claimed in claim 6 wherein the step of forming the side accessory rails includes forming a plurality of transverse ribs in each of the side accessory rails and defining and separating adjacent ribs of the plurality of transverse ribs by crosscuts.

8. A method as claimed in claim 7 wherein the step of forming the side accessory rails includes forming a plurality of pocket cuts in each of the side accessory rails intermediate the transverse ribs and along the central groove.

9. A method of fabricating a hand guard assembly for a firearm including a barrel, the method comprising the steps of:

extruding a tubular unitary body with an inner diameter sufficient to surround a portion of the barrel substantially coaxially and in a transversely spaced relationship; and forming a plurality of air flow openings through the extruded tubular unitary body by removing material from the body;

the step of extruding the tubular unitary body further includes forming a bottom accessory rail on a bottom surface of the tubular body, the bottom accessory rail being extruded as a unitary portion of the tubular body; and the step of forming the bottom accessory rail includes forming opposed longitudinally extending side grooves in the bottom accessory rail, the side grooves being formed to define external reference surfaces for mounting accessories.

10. A method as claimed in claim 9 wherein the step of forming the bottom accessory rail includes forming a longitudinally extending central groove in the bottom accessory rail midway between the opposed side grooves, the central groove being formed to define internal reference surfaces for mounting accessories.

11. A method as claimed in claim 10 wherein the step of forming the bottom accessory rail includes forming a plurality of transverse ribs in the bottom accessory rail and defining and separating adjacent ribs of the plurality of transverse ribs by crosscuts.

12. A method as claimed in claim 11 wherein the step of forming the bottom accessory rail includes forming a plurality of pocket cuts in the bottom accessory rails intermediate the transverse ribs and along the central groove.

* * * * *